United States Patent [19]

Moore et al.

[11] Patent Number: 5,059,984

[45] Date of Patent: Oct. 22, 1991

[54] METHOD AND APPARATUS FOR INTERLACED MULTICOLOR PRINTING

[75] Inventors: John S. Moore, Beaverton, Oreg.; Jeffrey J. Anderson, Camas, Wash.; Joern B. Eriksen, Oregon City, Oreg.

[73] Assignee: Tektronix, Inc., Beaverton, Oreg.

[21] Appl. No.: 528,518

[22] Filed: May 25, 1990

[51] Int. Cl.[5] ..... B41J 2/21

[52] U.S. Cl. ..... 346/1.1; 346/140 R; 358/75

[58] Field of Search ..... 346/1.1, 140, 75; 358/75, 78, 80

[56] References Cited

U.S. PATENT DOCUMENTS

| | | | |
|---|---|---|---|
| 4,528,576 | 7/1985 | Koomora | 346/140 |
| 4,554,556 | 11/1985 | Hirata et al. . | |
| 4,580,150 | 4/1986 | Tazaki . | |
| 4,593,295 | 6/1986 | Matsufuji et al. . | |
| 4,630,076 | 12/1986 | Yoshimura . | |
| 4,680,596 | 7/1987 | Logan . | |
| 4,714,936 | 12/1987 | Helinski et al. | 346/140 |
| 4,728,968 | 3/1988 | Hillmann et al. . | |
| 4,741,930 | 5/1988 | Howard et al. . | |
| 4,812,859 | 3/1989 | Chan et al. . | |
| 4,864,328 | 9/1989 | Fischbeck | 346/140 |
| 4,965,593 | 10/1990 | Hickman | 346/140 |
| 4,967,203 | 10/1990 | Doan | 346/140 X |
| 4,978,971 | 12/1990 | Goetz | 346/140 X |

*Primary Examiner*—Joseph W. Hartary

*Attorney, Agent, or Firm*—John D. Winkelman; Edward B. Anderson

[57] ABSTRACT

Printing is by an array of color-printing elements or nozzles in order ot produce interlaced color printing while printing each line only once with each color. Print head array configurations for printing two, three and four colors include linear and parallel arrays. In one embodiment, a first color and a second color are printed on alternate lines of a first set of print lines. The first color and a third color are printed on alternate lines of a second set of print lines. Also, the second color and the third color are printed on alternate lines of a third set of print lines. By sequentially printing these consecutive sets of lines on a print medium, with each of the three pairs of colors, all of the lines of an image are printed once with each color. Other color-printing configurations are also shown.

36 Claims, 4 Drawing Sheets

METHOD AND APPARATUS FOR INTERLACED MULTICOLOR PRINTING

FIELD OF THE INVENTION

This invention relates to color printing wherein a color image is formed by printing repeated sets of lines with different colors by a print head scanning a print medium. It particularly relates to color printing with interlacing of at least two colors, such as two of the three conventional subtractive primary colors, cyan, magenta and yellow.

BACKGROUND OF THE INVENTION

The preferred method and embodiment for practicing the present invention is particularly directed to an ink jet printer wherein a print head scans over a print medium, most typically a sheet of paper or transparent film, by shuttling back and forth across the sheet (bidirectional movement) or by moving continuously along the sheet in one direction while the sheet is held against a rotating drum. Images are formed by selectively and serially depositing ink drops of primary or base colors at uniformly spaced address locations disposed in uniformly spaced rows to form a dot-matrix image. Variations in color may be achieved by depositing one or more ink drops of more than one size or color at an address to form picture elements or pixels.

The present invention however is equally applicable to any printing process wherein a print head travels along parallel lines relative to a print medium to form a desired final image, whether the image be graphic or textual. In the following text, the term "print" is considered to include the general situation where a print element or nozzle addresses an ink drop location, whether or not ink is deposited. In the general situation the size of the drop may vary and even the number of drops of a given color that are deposited at a particular address can vary. Hewlett-Packard Labs has demonstrated the latter with drop-on-demand (DOD) thermal ink jets; and Hertz, at the Lund Institute in Sweden, has also demonstrated this with continuous ink jets. Printing with drops of several selected sizes (for gray scale control at each address) was demonstrated by MRIT with air assisted DOD jets in the early 1980s.

Print heads are known that contain a nozzle for each color of printing for a single line. These nozzles are positioned adjacent to a sheet of paper. A print head carriage then moves relative to the paper one line at a time depositing ink pixels at selected pixel locations until the entire image area has been scanned.

Representative of the prior art techniques is that disclosed in U.S. Pat. No. 4,630,076 issued to Yoshimura for "Ink-On-Demand Color Ink Jet System Printer". The devices disclosed therein show a plurality of sets of jet or nozzle arrays providing printing of all of the colors on each of a given set of print lines in a single scan of the print head (band printing). These devices print the color drops in one order when the print head is travelling in one direction, and in the reverse order when travelling in the other direction. This printer thus does not provide any form of interlacing: band, line, or color. Inks that bleed when printed therefore will mix within colors on a single line as well as between lines.

A variation of this technique is illustrated in U.S. Pat. No. 4,593,295 issued to Matsufuji et al. for "Ink Jet Image Recording Device with Pitch-Shifted Recording Elements". A double set of printing arrays are disclosed and offset in the direction of relative print medium movement so that the colors can be printed in the same order for both scan directions. As with the printer of Yoshimura, this printer prints all of the colors on a single line in a single pass of the print elements over a set of print lines.

Other ink jets have more than one nozzle to print a given color on each address of a given line. One nozzle is used to print ink at its maximum optical density, and the other(s) to print ink at some diluted dye concentration(s) so that more than one optical density level of the color can be obtained at each address. Again, such techniques involve the near simultaneous depositing of ink drops on pixel or image elements that are effectively in adjacent lines or in the media advance direction, as well as on the same pixel or image element. The resulting bleeding produces visually perceptible lines in the direction of print head traverse or scan across a print medium.

Some early printers also had the nozzles aligned normal to the scan direction for scanning spaced-apart parallel lines. Thus, colors are always laid down in the same sequence, and one color has time to dry before the next one is printed on top of it. Such systems do not provide for color, line or band interlacing, since printing is done with a single nozzle for each color.

Hirata et al., in U.S. Pat. No. 4,554,556 entitled "Color Plotter", disclose printing a dot with all three colors at once, or sequentially during a single scan. Tozaki, in U.S. Pat. No. 4,580,150 entitled "Recording Apparatus", disclosed a print array in which two nozzles are used to print one color in a limited image region and then a single nozzle is used to print a second color over the same region. These systems produce bands of print, print multiple colors in a single scan, and do not provide interlacing.

An example of band color printing in which the color arrays are spaced in the scan direction is disclosed by Helinski et al. in U.S. Pat. No. 4,714,936 entitled "Ink Jet Printer". A black array is also provided that has more nozzles than those in the individual color arrays. No band, line or color interlacing is provided. All colors are deposited on a line in a single scan, so mixing of inks occurs.

A form of line interlacing of band color printing is disclosed by Hillmann et al. in U.S. Pat. No. 4,728,968 entitled "Arrangement of Discharge Openings in a Printhead of a Multi-Color Ink Printer". For letter quality printing, the array is moved one half the draft-quality line spacing to print higher resolution images. This requires a different print medium advance after alternate scans. Again, all of the colors in a given line are printed during a single scan of the print head across the medium.

Color arrays spaced in the direction of print medium movement are also disclosed in the references. Logan, in U.S. Pat. No. 4,680,596 entitled "Method and Apparatus for Controlling Ink-Jet Color Printing Heads", discloses such arrays for printing dots in pixels to vary color tone. In this patent, three dot rows, forming a single pixel row, are printed with each color during each scan. This, then, is a form of solid band printing of each color. The head measures about two inches by three inches. There is no band or line interlacing of colors. Further, with multiple ink drops per pixel per scan, there is mixing of ink of the same color, which creates line artifacts.

Another example of color-band-printing arrays spaced in the direction of medium movement is disclosed by Chan et al. in U.S. Pat. No. 4,812,859 entitled "Multi-Chamber Ink Jet Recording Head for Color Use". Four heads, one for each primary color and black, print adjacent solid bands. Band artifacts are thus produced and there is no line, band or color interlacing.

In band printing by color arrays spaced in the direction of print medium movement, each color dries before the next color is deposited, and the colors are always deposited in the same sequence. When the color arrays are spaced only in the direction of scan movement, all the colors are deposited during each scan and the sequence of deposition is reversed for the two scan directions.

Prints generated by some serial dot-matrix color printers exhibit noticeable streaks parallel to the pen scan direction in areas printed in solid colors. These streaks can be either higher or lower in optical density than the surrounding area and occur where a band of color printed in one scan abuts a band of color printed in the next scan. Mechanical errors in paper advance mechanisms and ink bleeding are two of the causes for this. To minimize the effect, the bands of color should be interlaced rather than abutted. As discussed herein, band interlacing of a color refers to the partial overlapping of a first printed band of the color with a subsequent printed band of the same color. This also requires line interlacing and results in the spacing apart of any printing defects due, for example, to a defect in a single printing element.

Line interlacing means that adjacent lines of dots of the same color are printed in sequential scans of the pen. For example, lines 1, 3, 5, etc., might be printed in one scan, while lines 2, 4, 6, etc., would be printed in the next scan. In a high speed printer, it is desirable to print in both scan directions. With line interlacing, any printing errors and hence image defects that might be dependent on the scan direction would be generated at the spatial frequency of the inverse line spacing and should be less noticeable than if they were generated at a lower spatial frequency.

Different types of inks are used in drop-on-demand printing. These are primarily water-based inks, oil-based inks, and hot-melt or thermoplastic inks. The latter inks are preferred, due to the intensity of the colors and the fact that they can be used on many different print mediums. A discussion of printing with colored inks, generally, and with hot-melt inks, in particular, is discussed by Howard et al. in U.S. Pat. No. 4,741,930 entitled "Ink Jet Color Printing Method". This patent specifically discloses the ink itself, rather than a printing process, other than disclosing that it is desirable to apply the different colors of ink to a spot after the prior application has set.

If dots of hot-melt ink that have not set are deposited continuously together or on top of each other, they mix. When they mix, the resultant color is different than it is if the first dot solidifies before the second dot is deposited. The color laydown sequence is also important. Different sequences produce color hue shifts and appearances of surface irregularities.

Ideally then, each of the multicolor overlay sequences should always be the same regardless of scan direction. If this is not possible, then the next best thing is to have the sequences alternate on adjacent lines so that the spatial frequency of the hue variations will be as high as possible and will be averaged out as much as possible by the visual system of an observer.

It can therefore be seen that it is desirable to provide line interlacing of each of the colors, band interlacing of each of the colors, and constant overlay sequence for each of the two-color combinations when printing bi-directionally.

SUMMARY OF THE INVENTION

These features are variously provided by the present invention. Depending on the characteristics of the inks and mechanical systems used, the present invention provides a method and apparatus for substantially reducing color image irregularities while minimizing the number of address lines spanned by the array.

The preferred embodiment of the present invention is usable in a serial, dot-matrix, print-on-demand ink jet head described in U.S. Pat. No. 4,978,971 issued to Goetz et al. for "Method and Apparatus for Reformatting Print Data", assigned to the same assignee as the present invention. This disclosure describes an ink jet printer for printing band and line interlacing with a single color such as would be used for monochromatic graphic or text images. This application is incorporated herein by reference.

The present application further improves on the above application and on the known prior art by providing improved color imaging. Generally, the present invention provides a method and apparatus for printing a color image on a print medium along print lines having centers spaced a predetermined interline distance apart.

The method generally includes printing first and second colors on alternating lines of a first set of lines, and subsequently printing the first and second colors on a second set of print lines while printing the first color on lines of the first set of colors previously printed with the second color. Preferably the second color or a third color is also printed on the lines of the first set simultaneously with printing of the first color.

This color interlacing may be extended to include four interlaced colors printed simultaneously or in various combinations of interlaced sets. Interlacing of two, three and four colors is specifically illustrated in order to achieve various combinations of line and band interlacing and overlay sequences.

In a preferred method according to the present invention for interlacing three colors, a first color and a second color are printed on a first set of print lines, with the first and second colors being printed on respective alternate print lines. During printing on the first set of print lines, the first color and a third color are printed on a second set of print lines, with the first and third colors being printed on respective alternate print lines. Also during printing on the first set of print lines, the second color and the third color are printed on a third set of print lines, with the second and third colors being printed on respective alternate print lines. In this preferred method, there are no lines between the sets of lines to be printed on that are skipped. Also, each color must be printed by the same number of jets, N, where N is an even integer.

By sequentially printing these consecutive sets of lines on a print medium with each of the three pairs of colors, all of the lines of an image are printed once with each color.

This method provides color printing with two of the color pairs alternating by line in order of color overlay, and with a constant order of color overlay for the third color pair. Other combinations will be seen to provide various mixes of band and line interlacing of individual colors, and either constant or alternating line overlay sequences.

In yet another preferred method, particularly suited for hot-melt ink applications, during each pass of a print head over a print medium, the same lines are printed by first and second sets of printing elements. Each set of printing elements prints alternating lines of two colors, with the two sets of printing elements printing different colors. Thus, four colors are printed. The printing elements are aligned so that yellow and magenta are printed on the same lines and black and cyan on the same lines. There are equal numbers of printing elements printing each color. The print medium advances relative to the print head after each pass a distance equal to the interline distance times the number of lines addressed by the printing elements printing a single color.

This not only results in band and line interlacing, but also line alternating overlay sequences, except for the occurrence of repeat overlay sequences for yellow and magenta. The combination of yellow and magenta produce red, a color to which the eye is comparatively insensitive. Further, green, the additive primary color the eye is most sensitive to is produced by overlaying cyan and yellow. These colors are overlaid on different passes of the print head so that the first deposited color has time to set before the second is deposited on it. This assures apparently uniform color shades. Differences resulting from different overlay sequences alternate every line, so the eye does not distinguish the difference.

These and other features and advantages of the present invention will become apparent from a reading of the following detailed description of the preferred embodiment and method for practicing the present invention when read with reference to the associated drawings.

BRIEF DESCRIPTION OF THE DRAWINGS

FIG. 7 illustrates printing using a conventional head configuration.

DETAILED DESCRIPTION OF THE PREFERRED EMBODIMENT

Figure 1:
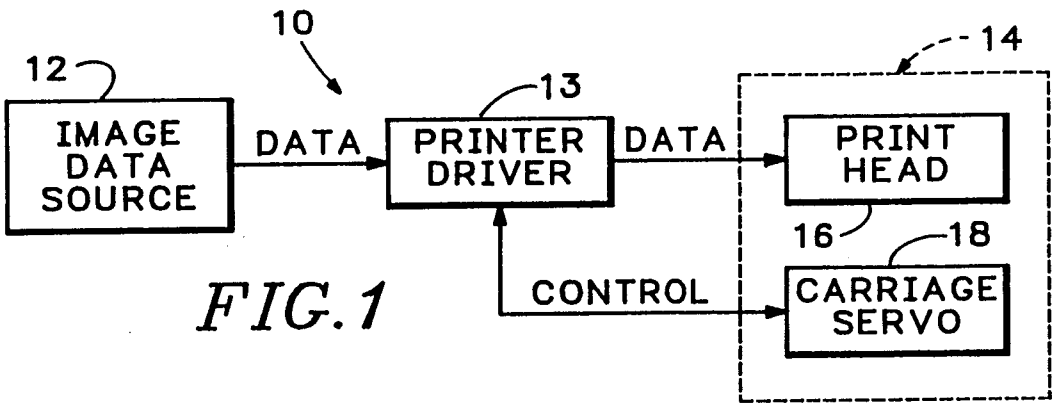
FIG. 1 is a general block diagram illustrating a printer apparatus for practicing the present invention.

Referring initially to FIG. 1, a serial, dot-matrix printer 10 usable for practicing the present invention is shown. Printer 10 receives scan data from a data source 12. This data defines the colors to be printed at each pixel location on a predetermined image area of a print medium.

The data is fed into a printer driver 13 that controls operation of a print engine 14. Control includes feeding formatted data to a print head 16, the movement of which is provided by a carriage controlled by a carriage servo 18. Control signals are exchanged between the printer driver, the carriage servo, and other mechanical systems, not shown, such as a print medium mover to provide coordinated movement of the print head relative to the print medium during printing. A detailed description of a printer 10 usable for practicing this invention, is as described in the previously reference application entitled "Method and Apparatus for Interlaced Printing". That application also describes well known prior art techniques for interlaced printing in a single color.

Figure 2:
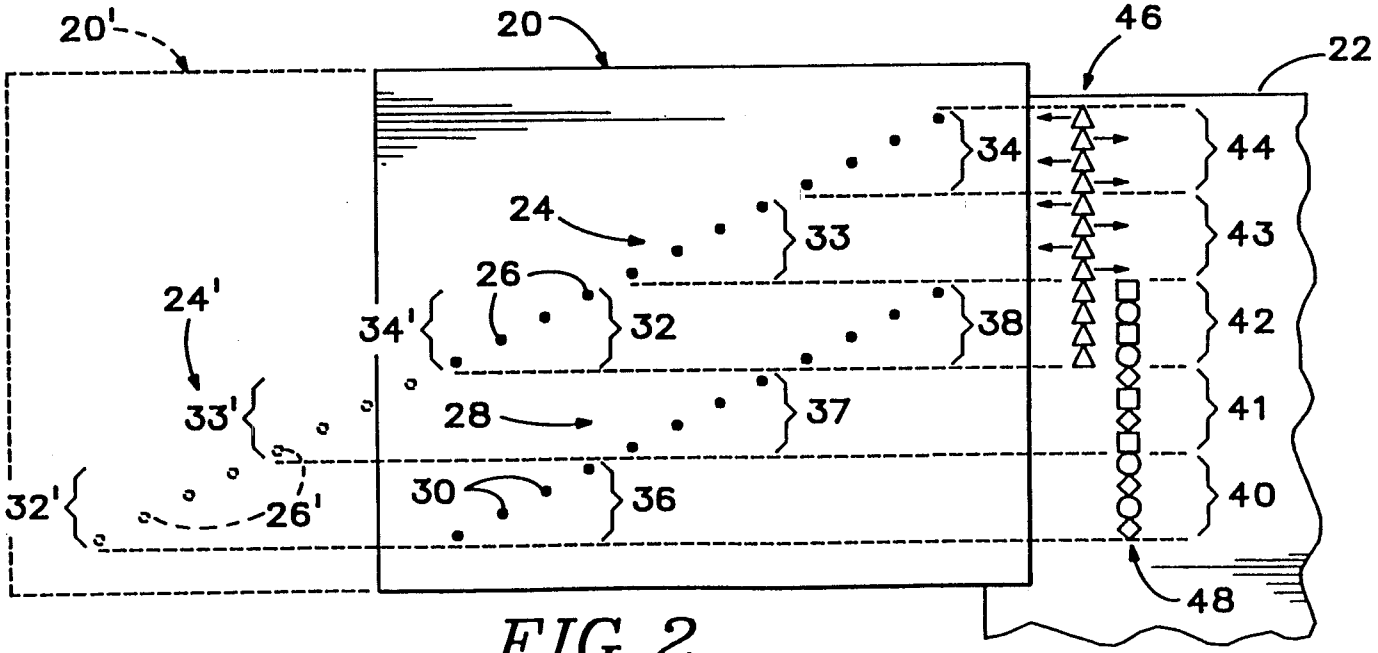
FIG. 2 is a diagram illustrating an exemplary ink jet head array and representative color print scan of a print medium.

Referring now to FIG. 2, an exemplary print head nozzle array 20 usable in printer 10 is shown positioned next to a print medium 22, such as a sheet of suitable paper. Array 20 includes a first group 24 of individual black-ink-printing nozzles 26, and a second group 28 of color-ink-printing nozzles 30. It will be understood that black, white and various colors of the color spectrum in between are all considered colors. Array 20, and associated print head 16 thus prints using a plurality of colors.

There are 12 nozzles in each group of nozzles in the array. These groups are divided into three sets of four nozzles. Group 24 comprises sets 32, 33 and 34. Group 28 comprises sets 36, 37 and 38. Group 24 is positioned vertically (in the direction of the print medium movement) above group 28 so that sets 32 and 38 print on the same lines during a single scan of the array. The six sets of nozzles thus print five sets 40, 41, 42, 43 and 44 of lines in a single scan.

In this figure and in FIGS. 3–12 which follow, ink colors are represented by a geometric symbol. In FIG. 2, a triangle represents black, and a square, a diamond, and a circle each represent one of three other colors, such as the three conventional subtractive primary colors, magenta, cyan and yellow. Other colors could also be used.

A column 46 of triangles on print medium 22 indicates the lines addressed and that may be printed by the nozzles in group 24. A column 48 of squares, diamonds, and circles indicates the lines addressed by the nozzles in group 28. There is a mix of colors in column 48 that will be more fully discussed with reference to FIG. 3. Between scans the array is shifted downward relative to the print medium, the width D equivalent of four print lines, or the width of one set of print lines.

In order to achieve band and line interlaced printing of black, as provided in the prior art, the lines of the top two set of black nozzles print alternate lines as illustrated by the arrows associated with the triangle symbols. The arrows indicate which nozzles print during scan movement in the direction shown by the arrows.

The array configuration provides for printing with black ink after the primary colors are printed. This is important where the inks do not dry quickly or where there is bleeding of the colors. By printing black last, a constant sequence of deposition is provided relative to the other colors. Also, when printing only black text, group 28 is disabled and all nozzles in group 24 are used so that printing can take place three times as fast as during color image printing.

FIG. 2 shows an "ideal" embodiment in that black is always printed on a given line after all of the other colors have been printed. (Note: there is no occasion when black is ever printed at the same address as any of the other colors. Further, there is never an occasion when all of the three subtractive colors are printed at the same address.) This "ideal" embodiment extends the nozzle array in the vertical direction more than would be preferred. An alternative embodiment, shown in dashed lines in FIG. 2, has the black array 24' shifted so that there is a black nozzle 26' on every line there is a color nozzle. This is the most compact embodiment in the vertical direction, and in this sense, is also an "ideal" embodiment.

It should be noted that array 20 or 20' is representative. The intended commercial embodiment is four times the size of array 20'. That is, there are 48 black-printing nozzles, and 48 multicolor-printing nozzles. Thus, instead of sets of 4 nozzles, there are sets of 16 nozzles. However, the color sequences are the same as those shown, just longer.

The three base colors can be fed to nozzles 30 in any order desired. However, only specially ordered configurations will result in all lines being printed once and only once by each color. FIGS. 3–13 illustrate various arrangements that satisfy various ones of the desired features of a color printing system discussed earlier. In these figures, time is considered to progress from left to right. Thus, symbols shown on the same print line are considered to overlay each other, with the sequence of deposition occurring as determined by the deposition timing identified by sequential scans 1–3 or 4.

Figure 4:
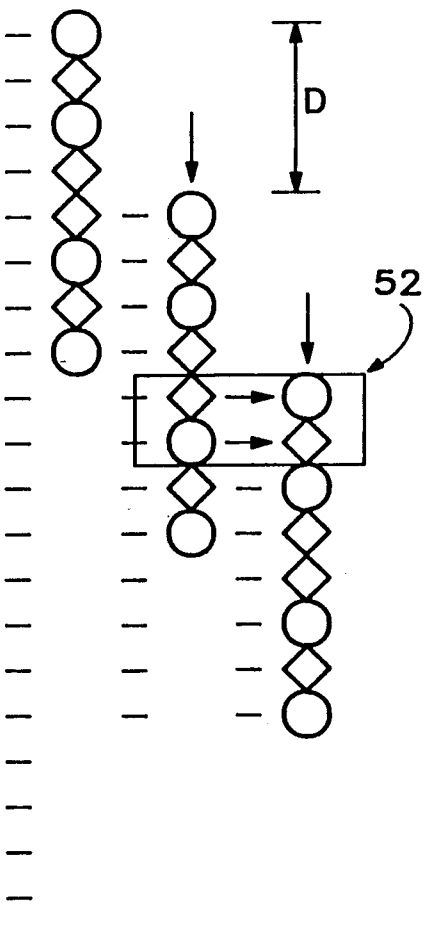
FIGS. 3 and 4 illustrate two-color printing using two configurations of the nozzles in a print-head array like that of FIG. 2 for achieving different overlay sequence combinations.
Figure 3:
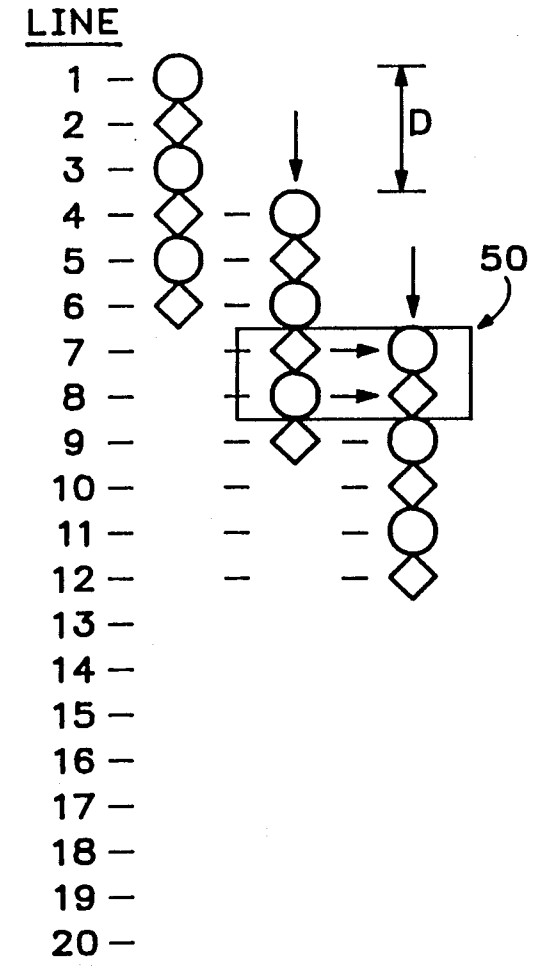

FIGS. 3 and 4 illustrate two configurations for printing two colors with color interlacing. FIG. 3 shows two colors represented as circles and diamonds that simply alternate within a set of printing elements for printing line-by-line alternating colors. In order to provide for constant incremental movements of the print head relative to the print medium, the number N of nozzles must be odd.

In FIG. 3, there are three nozzles of each color and the print head is shifted a distance D equal to the width of three lines between scans. The resulting overlay sequence is represented in the outlined region 50. It can be seen that the overlay sequence alternates with every line, except for the band edges.

This method and configuration provide for band and line interlacing. The band of a particular color is 5 ($2N-1$ for $N=3$). Incrementing by $N=3$ lines is as close as possible to get to $(2N-1)/2$ lines when incrementing by an integer number of lines. Line interlacing results because each color is printed on only odd numbered lines in one scan and only on even numbered lines in the next scan, since the incremental distance change D is equivalent to the width of an odd number of lines.

An alternative two-color printing configuration is shown in FIG. 4. The head color array is made up of two sets of four nozzles, with the nozzles alternating colors within each set, but with the placement of colors in each set reversed. For instance, during scan 1, the color represented by a circle prints on lines 1 and 3 in the first set and on lines 6 and 8 in the second set. As can be seen, the color in one set always prints on the odd lines and the same color in the other set always prints on the even lines.

As shown in outlined region 52, the overlay sequence alternates every line. Considering that the band of circles encompasses eight lines, and that for diamonds encompasses six lines, the circles have near perfect band interlacing, whereas the diamonds have partial band interlacing. Also, it can be seen that the diamonds are printed on two consecutive lines during each scan. Otherwise line interlacing is also achieved.

Figure 5:
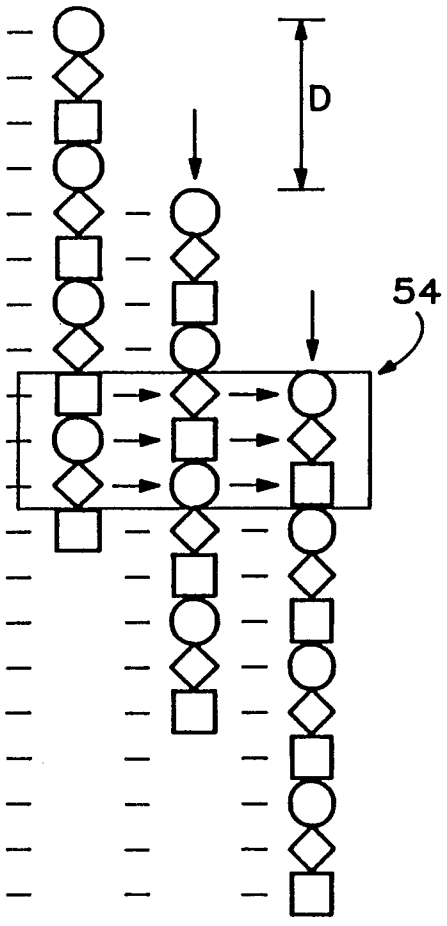
FIGS. 5–10 illustrate three-color printing with different head configurations.

FIGS. 5–10 show different head configurations for printing three colors, such as the primary subtractive colors, cyan, magenta and yellow. FIG. 5 illustrates the case where the three colors alternate within a single set of nozzles. In order to avoid duplicate printing of some lines, N, the number of nozzles of each color, must not be an integer multiple of three. In the example shown, there are four nozzles of each color and the array is advanced the width D of four lines between scans.

As shown by the outlined region 54, each line is only addressed once, and the overlay sequence of each color pair does not alternate perfectly line-by-line. The order of circle/square, square/diamond and diamond/circle repeats every two out of three lines. However, there is both band and line interlacing of each color.

Figures 6, 7, 8, 9:
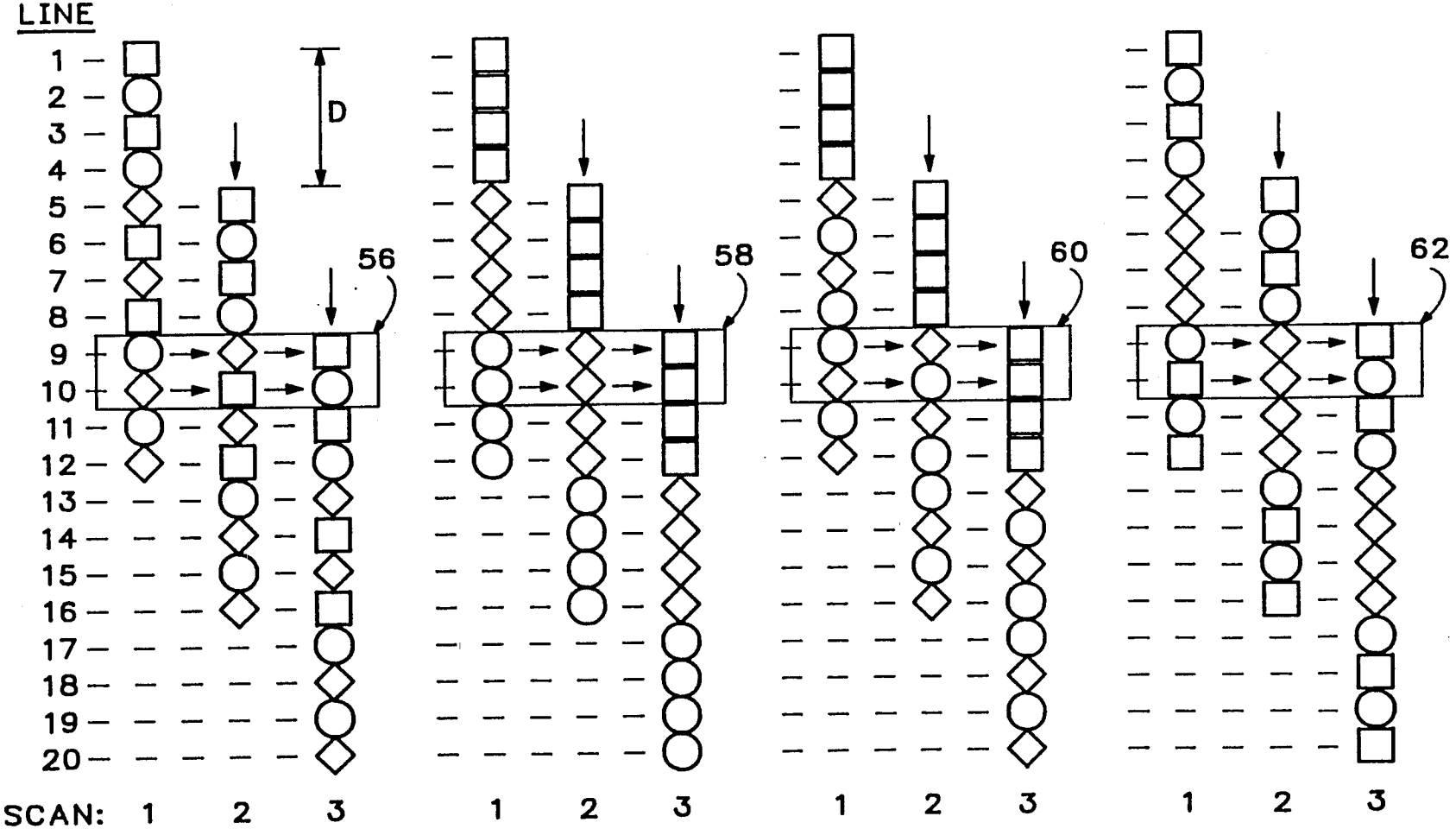
FIG. 7 PRIOR ART

The configuration shown in FIG. 6 is the same as that illustrated in FIG. 2 for the jets that print in color. Referring specifically to FIG. 6, three sets of four nozzles are used, with each set printing alternating lines of two colors. Each set prints a different one of the three pairs of colors: square/circle, diamond/square and circle/diamond. In the scan sequence shown, lines 9 and 10 are the first lines to be overlaid by all three sets of nozzles. The resulting overlay sequence is represented in the outlined region 56. The ink drop locations in line 9 are addressed ("printed") first by the nozzle printing the color represented by the circle, followed by the nozzle printing a diamond and then by a nozzle printing a square. Thus, the circle is printed before both the diamond and the square, and the diamond is printed before the square.

Preferably, no more than two colors are printed at a single ink drop address location. Printing all three at one address results in "composite" or "three-color" black which always has a noticeable, dingy and repugnant hue. This arises because the subtractive primary colors are not ideal. Thus, it is better to print a single drop of pure black.

In line 10, the diamond is printed before the square and the circle, and the square is printed before the circle.

This alternating pattern applies to all of the lines printed, as could be illustrated by continuing to draw columns for scans 4 and beyond.

Relating this to FIG. 2, diamonds (a first color) and circles (a second color) alternate in first set 36 of print elements, squares (a third color) alternate with diamonds in second set 37 of print elements, and circles alternate with squares in third set 38. It will be seen that when a color is printed on odd lines in one set it is printed on even lines in a different set, so that all lines will be printed by each color.

The printing method illustrated in FIG. 6, and the print element array associated with it, provide for band interlacing of squares and diamonds, and line interlacing of all three colors. The bands of squares and diamonds each span thirty-two lines in this, the intended commercial embodiment. This array also provides a constant deposition order for one pair of colors (diamonds and squares), and provides alternative deposition orders for the other two pairs of colors (circles and diamonds, and circles and squares) on adjacent lines.

In FIG. 7, each of print head sets 36, 37 and 38 have a single color, as is conventionally known. The first set is circles, the second set is diamonds, and the third set is squares. As shown in outlined region 58, this results in the three colors being deposited in a constant order for all lines printed. That is, the circles are printed before both the diamonds and the squares, and the diamonds are printed before the squares. However, each color is neither band interlaced nor line interlaced.

FIG. 8 shows yet another embodiment, this one having the first two print element sets 36 and 37 alternating between circles and diamonds, and the third set 38 all squares. As shown by outlined region 60, this embodiment provides both line and band interlacing for two colors (circles and diamonds) and a constant color overlay sequence for two of the color pairs (diamonds and squares, and circles and squares). However, the third color (squares) is neither line nor band interlaced.

In FIG. 9 the set 37 of printing elements printing a single color, diamonds in this case, is in the middle. The first and third sets 36 and 38 alternate colors represented by squares and circles. As shown by outlined region 62, this configuration provides alternating overlay sequences for all three color pair combinations. However, one of the colors—diamonds—is not line interlaced. There is no band interlacing at all.

Figures 10, 11, 12, 13:
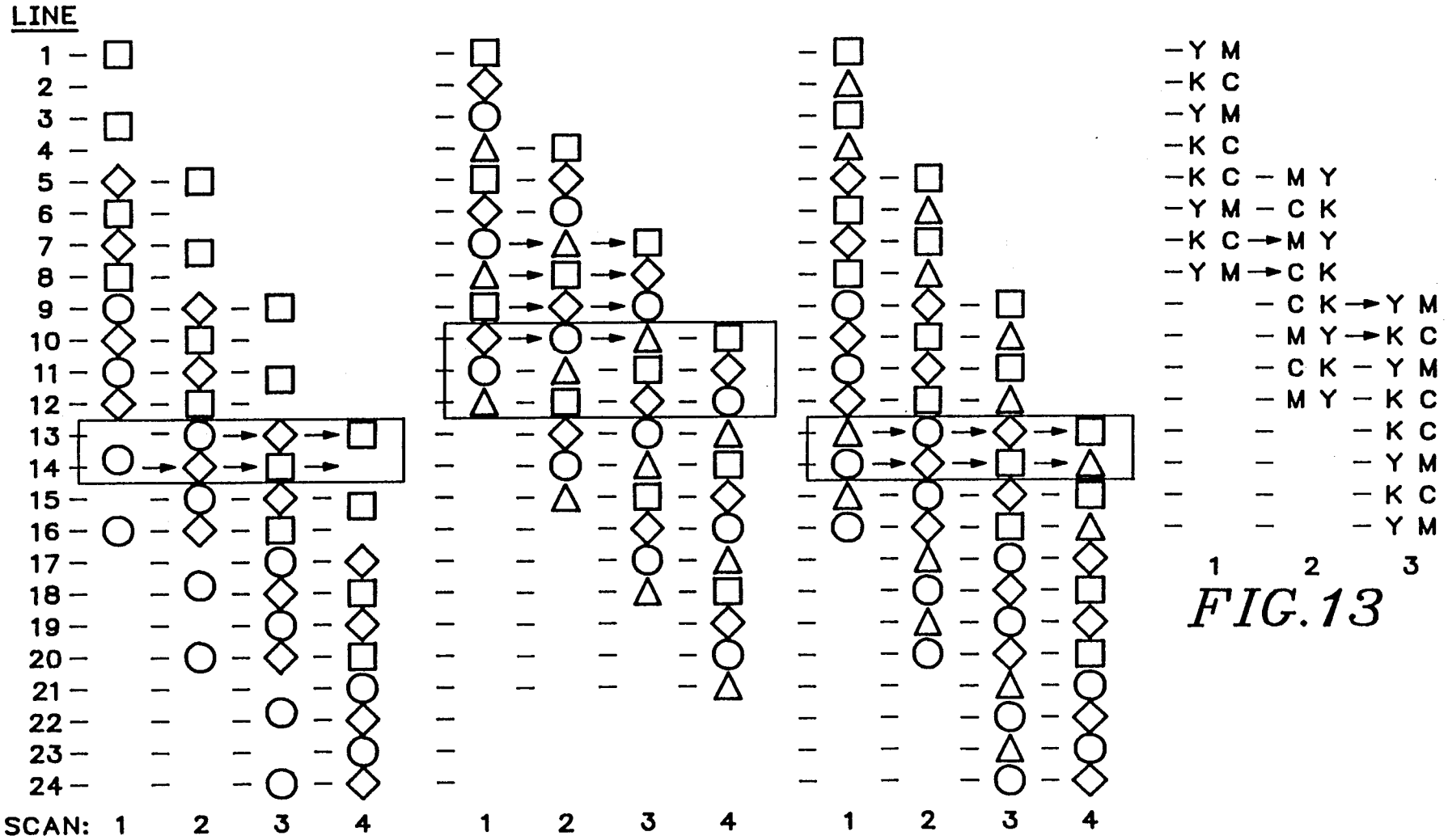
FIGS. 11–13 illustrate four-color printing with different head configurations.

The last three-color configuration is illustrated in FIG. 10. This configuration diverts from the previous configurations in which every line within the range of the print array is printed (addressed). This configuration requires four sets of nozzles. The two end sets each print a different single color on alternating lines. The two intermediate sets print alternating lines of two different color pairs. Four scans are required in order to have each line addressed by each of the colors, as is illustrated in outlined region 64.

This configuration, though it requires a larger print head ($4N-1$ rather than $3N-1$ address lines), provides a constant overlay sequence for all three colors. Further, there is band interlacing and line interlacing for all three colors.

FIGS. 11–13 illustrate configurations for printing four colors. In FIG. 11, there is a single set with the colors alternating in each set. If N, the number of nozzles per color, is even then the print head must be incremented on alternating scans by $N-1$ and $N+1$ lines. For N odd, regular increments of N lines after each scan provides printing of each color once on every line.

$N=3$ in the figure. As shown in outlined region 66, four scans are required in order to have every line addressed by every color. This results in three increments per band, which averages out any anomalies due to band edges. There also is complete line interlacing. However, the overlay sequences vary between not alternating at all to alternating every second line. The results are therefore inconsistent.

FIG. 12 illustrates a preferred arrangement for printing four colors, where all four colors are given an equal number of nozzles. In this case a first set of four nozzles alternates between triangles and squares, the second set between diamonds and squares, the third set between diamonds and circles, and the last set between triangles and circles, as shown. The respective colors are assigned so that they print on even lines in one set and on odd lines in the other set in which they appear. A comparison on this configuration with the three-color configuration of FIG. 10 will show that they are identical as to the colors represented by squares, diamonds and circles. The triangles have been added where there were nozzle omissions in FIG. 10.

As is apparent in the outlined region 68, the overlay sequence is the same for the three colors of FIG. 10. The sequences alternate every line for the combinations with the fourth color. This scheme would therefore be useful where black is assigned to the triangle positions and the three primary colors are assigned the other three symbol positions. This configuration produces line and partial band interlacing.

FIG. 13 illustrates a configuration in which the four colors are treated as two sets of two colors. Each pair of colors, here yellow (Y) and black (K), and magenta (M) and cyan (C) are given the same array configuration as the two colors of FIG. 4. There are thus two sets for each color pair, with the two arrays printing on the same print lines. Alternatively, one two-color array could be positioned vertically, as represented here, to form a single line of both arrays so that there is a delay between the printing of color pairs. The print head in such an arrangement is, however, much less compact.

The configuration of FIG. 13 is particularly desirable for hot-melt ink, where the inks combine when placed on top of or next to drops of ink that are not set. Since black is not applied to a spot that has another color, it is never combined on the same spot with other colors. The main color combinations alternate line-by-line except for yellow and magenta, which produce red, as shown by outlined region 70. This color pair stays the same on alternate two-line intervals. Since the eye is much less sensitive to red than to green, stripes or other anomalies will be less apparent. Alternatively, magenta and cyan, which produce blue, could also be used for this inconsistent color-overlay sequence pair. It is advantageous having cyan and yellow on different lines to allow the spots of ink to set between scans in order to produce a more consistent green.

As suggested by the embodiment shown in FIG. 10, the nozzles could be vertically separated by twice the interline spacing so that no two color dots within the same array print on adjacent lines. This, however, doubles the size of the array.

As has been indicated, the head arrays, numbers of sets of colors and numbers of each color in each set can be varied while practicing the present invention. It will therefore be appreciated that variations in form and detail may be made in the embodiments described without varying from the spirit and scope of the invention as defined in the claims.

We claim:

1. A method of interlaced printing a multiple-color image on a print medium along print lines having centers spaced a predetermined interline distance apart, the method comprising the steps of:

printing simultaneously on a first set of adjacent print lines a first color and a second color different from the first color, such that the colors are printed on different lines and alternate along the lines of the first set; and after completing the step of printing lines of the first set with the first and second colors, printing simultaneously on a second set of adjacent print lines the first and second colors such that the colors are printed on different lines and alternate along the lines of the second set, while printing on the first set of print lines the first color on lines not printed previously with the first color, whereby adjacent lines of the first set are not printed simultaneously with a color.

2. A method according to claim 1 wherein the step of printing the first color on the first set of print lines while printing on the second set of print lines, includes printing the second color on lines of the first set of print lines not printed previously with the second color.

3. A method according to claim 1 further comprising printing a third color on lines of the first set.

4. A method according to claim 3 wherein the step of printing a third color includes printing the third color on lines not printed by the first and second colors simultaneously with the printing of the first and second colors.

5. A method according to claim 3 further comprising printing a fourth color on lines of the first set.

6. A method according to claim 5 wherein the steps of printing the third and fourth colors includes printing the third and fourth colors on lines not printed with the first and second colors simultaneously with the printing of the first and second colors.

7. A method according to claim 6 wherein the steps of printing the four colors includes printing simultaneously the four colors alternatingly along the lines.

8. A method according to claim 5 wherein the steps of printing the third and fourth colors includes printing simultaneously the third and fourth colors on the same lines on which the first and second colors are printed with the third and fourth colors being printed alternatingly along the lines.

9. A method according to claim 8 wherein the four colors are printed simultaneously.

10. A method according to claim 9 for printing with hot-melt ink, wherein the steps of printing the four colors includes printing magenta and cyan as the first and second colors and printing black and yellow as the third and fourth colors.

11. A method according to claim 10 wherein the steps of printing the four colors includes printing simultaneously yellow and magenta on the same lines and black and cyan on the same lines.

12. A method according to claim 3 wherein the step of printing the third color includes printing the third color on all of the lines of the first set on which the first and second colors are printed.

13. A method according to claim 5 wherein the step of printing the fourth color includes printing the fourth color on the same set of print lines as the lines printed with one of the first, second, and third colors, after printing the one of the first, second, and third colors.

14. A method according to claim 3, wherein the step of printing the third color includes printing on lines of the first set, after printing the lines of the first set with the first and second colors, the first color on lines alternating with respect to the lines printed with the third color such that no line is printed twice with the same color.

15. A method of interlaced printing a multiple color image on a print medium along print lines having centers spaced a predetermined interline distance apart, the method comprising the steps of:

printing simultaneously and alternatingly along lines of a set of adjacent print lines a first color and a second color different than the first color;

after printing the first and second colors, printing simultaneously and alternatingly along lines of the set of print lines the first color and a third color different than the first and second colors; and after printing the first and third colors, printing on the set of print lines the second color; and printing on the set of print lines the third color;

the colors being printed such that no line is printed twice by the same color, each printed line is printed by one color at a time, and no two adjacent lines are printed simultaneously by the same color.

16. A method according to claim 15 wherein the step of printing the second and third colors includes printing the second and third colors simultaneously.

17. A method according to claim 15 wherein the step of printing the second color includes printing the second color and a fourth color simultaneously, and the step of printing the third color includes printing the third and the fourth colors simultaneously.

18. A method for printing a color image on a print medium along print lines having centers spaced a predetermined interline distance apart, the method comprising the steps of:

printing on a first set of adjacent print lines a first color and a second color, with the first and second colors being printed on respective alternate print lines;

during printing on the first set of print lines, printing on a second set of print lines the first color and a third color, with the first and third colors being printed on respective alternate print lines; and during printing on the first set of print lines, printing on a third set of print lines the second color and the third color, with the second and third colors being printed on respective alternate print lines.

19. A method according to claim 18 wherein the steps of printing on the first, second, and third sets of lines is repeated on respective second, third, and fourth sets of print lines such that no print line is printed twice with the same color.

20. A method according to claim 19 wherein the repeated steps of printing are further successively repeated on consecutive sets of print lines until each print line of the image is printed by the first, second, and third colors.

21. A method according to claim 20 wherein all of the steps of printing sets of print lines include printing sets having equal numbers of print lines.

22. A method according to claim 21 wherein the steps of printing comprise printing with a print head structured to print three equal sets of print lines simultaneously during each pass of the print head over the print medium, the method further comprising the step of advancing the print medium a distance equal to the width of the number of lines in a printed set relative to the print medium after each pass of the print head over the print medium.

23. An apparatus for printing a color image formed of lines printed selectively over a predetermined area of a print medium, which lines have centers spaced a predetermined interline distance apart, the apparatus comprising:

a print head movable relative to the print medium and having a first set of printing elements, the set including a plurality of printing elements structured for printing simultaneously a corresponding plurality of different adjacent print lines, each printing element printing a color, and the set of printing elements printing at least two alternating colors; and means for moving the print head relative to a print medium in a manner such that all of the lines of the image are printed only once with each color, whereby for each scan of the print head across the print medium, only one color is printed on each line and the colors alternate along the lines printed.

24. An apparatus according to claim 23 wherein the print head further includes a second set of printing elements for printing the same two alternating colors, the print head being structured so that, during a current pass of the print head, the second set of printing elements prints on the same lines as the first set of printing elements during a prior pass, with each line being printed only once with the same color.

25. An apparatus according to claim 23 wherein the print head further includes a second set and a third set of printing elements for printing three colors, each set of printing elements printing a different pair of colors, with each pair of colors alternating within each set of printing elements.

26. An apparatus according to claim 25 wherein the three sets of printing elements contain equal numbers of printing elements.

27. An apparatus according to claim 26 wherein the moving means advances the print head relative to the print medium a distance equal to the interline distance between lines times the number of lines printed by a set of printing elements.

28. An apparatus according to claim 25 wherein the print head further includes a fourth set of printing elements for printing a fourth color on the same lines previously printed by the printing elements in at least one of the first, second and third sets of printing elements that printed at least one of the first, second and third colors during a single pass of the print head over the print medium.

29. An apparatus according to claim 23 wherein the print head further includes a second set, a third set and a fourth set of printing elements for printing four colors, each set of printing elements printing a different pair of colors, with each pair of colors alternating within each set of printing elements.

30. An apparatus according to claim 23 wherein the set of printing elements prints three colors, with the three colors alternating within the set of printing elements.

31. An apparatus according to claim 30 wherein the set of printing elements prints four colors, with the four colors alternating within the set of printing elements.

32. An apparatus according to claim 23 wherein the print head further includes a second set of printing elements for printing simultaneously a third color and a fourth color, with the third and fourth colors being printed on alternating lines.

33. An apparatus according to claim 32 wherein the print head is structured for printing simultaneously with both the first set and the second set of printing elements on the same printing lines.

34. An apparatus according to claim 33 wherein the printing elements print with hot-melt ink, and the first, second, third and fourth colors are magenta, cyan, black and yellow.

35. An apparatus according to claim 34 wherein the two sets of printing elements are aligned for printing yellow and magenta on the same lines, and printing black and cyan on the same lines during each pass of the print head over the print medium.

36. An apparatus according to claim 23 wherein the print head further includes a second set of printing elements for printing a third color on all lines on which the first set of printing elements prints in a single pass of the print head over the print medium.

* * * * *